US008882427B2

(12) United States Patent
Borøy

(10) Patent No.: US 8,882,427 B2
(45) Date of Patent: Nov. 11, 2014

(54) METHOD AND DEVICE FOR HOISTING AN ITEM BY MEANS OF A CRANE

(75) Inventor: Yngvar Borøy, Songe (NO)

(73) Assignee: National Oilwell Varco Norway AS, Kristiansnad S. (NO)

( * ) Notice: Subject to any disclaimer, the term of this patent is extended or adjusted under 35 U.S.C. 154(b) by 366 days.

(21) Appl. No.: 13/201,672

(22) PCT Filed: Feb. 8, 2010

(86) PCT No.: PCT/NO2010/000045

§ 371 (c)(1),
(2), (4) Date: Oct. 3, 2011

(87) PCT Pub. No.: WO2010/093251

PCT Pub. Date: Aug. 19, 2010

(65) Prior Publication Data

US 2012/0034061 A1 Feb. 9, 2012

(30) Foreign Application Priority Data

Feb. 16, 2009 (NO) ..... 20090729

(51) Int. Cl.

| | |
|---|---|
| ***B63B 27/00*** | (2006.01) |
| ***B65G 67/60*** | (2006.01) |
| ***B63B 27/10*** | (2006.01) |
| ***B66C 13/04*** | (2006.01) |

(52) U.S. Cl.

CPC ..... *B66C 13/04* (2013.01); *B63B 27/10* (2013.01)

USPC ..... 414/137.7; 414/142.8; 414/137.5; 254/4 R; 212/307

(58) Field of Classification Search

USPC ..... 414/137.5, 137.7, 137.8, 141.3, 141.4, 414/142.6, 142.7, 800; 254/334–336, 278, 254/394, 4 R, 277; 212/270, 307–311; 114/51

See application file for complete search history.

(56) References Cited

U.S. PATENT DOCUMENTS

| | | | | |
|---|---|---|---|---|
| RE26,351 | E * | 2/1968 | Sheiry | 137/615 |
| 3,640,400 | A * | 2/1972 | Becraft | 212/311 |

(Continued)

FOREIGN PATENT DOCUMENTS

| | | | |
|---|---|---|---|
| WO | 03074353 | A1 | 9/2003 |
| WO | 2009005359 | A1 | 1/2009 |

OTHER PUBLICATIONS

International Application No. PCT/N02010/000045 Search Report and Written Opinion dated May 10, 2010.

*Primary Examiner* — Gregory Adams
*Assistant Examiner* — Lynn Schwenning
(74) *Attorney, Agent, or Firm* — Conley Rose, P.C.

(57) ABSTRACT

A method and a device for hoisting an item at sea with a hoisting device comprises moving the item between a plurality of different height levels. In addition, the method comprises alternately supporting the load of the item with a first hoisting rope and a second hoisting rope while moving the item between the plurality of different height levels. Further, the method comprises arranging the first hoisting rope and the second hoisting rope to extend in parallel along at least part of the distance between the item and the hoisting device. Still further, the method comprises releasably connecting the first hoisting rope to the second hoisting rope. Moreover, the method comprises suspending the second hoisting rope from a hanger when the second hoisting rope is supporting the load of the item. The method also comprises connecting the hanger to an arm of the hoisting device.

18 Claims, 4 Drawing Sheets

(56) References Cited

U.S. PATENT DOCUMENTS 4,179,010 A * 12/1979 Ashworth ..... 182/2.7
4,565,292 A * 1/1986 Spengel, Sr. ..... 212/232
4,892,202 A * 1/1990 Hey et al. ..... 212/309
7,976,246 B1 * 7/2011 Krabbendam ..... 405/224
8,016,521 B1 * 9/2011 Krabbendam ..... 405/228
2005/0191165 A1 9/2005 Willis et al.
2009/0261052 A1 * 10/2009 Vasstrand ..... 212/270

* cited by examiner

METHOD AND DEVICE FOR HOISTING AN ITEM BY MEANS OF A CRANE

CROSS-REFERENCE TO RELATED APPLICATION

This application is the U.S. National Stage under 35 U.S.C. §371 of International Application No. PCT/NO2010/000045 filed Feb. 8, 2010, which claims priority to Norwegian Patent Application No. 20090729 filed Feb. 16, 2009, entitled "Method and Device For Hoisting An Item By Means Of A Crane."

STATEMENT REGARDING FEDERALLY SPONSORED RESEARCH OR DEVELOPMENT

Not applicable.

BACKGROUND

This invention relates to a method for hoisting an item by means of a crane. More particularly, it relates to a method for hoisting an item at sea with a hoisting device, comprising:

- moving the item between different a first height and a second height
- alternately supporting the item with a first hoisting rope and then a second hoisting rope;
- arranging the first hoisting rope and the second hoisting rope to extend in parallel along at least a portion of the distance between the item and the hoisting device; and
- releasably connecting the first hoisting rope to the second hoisting rope. Embodiments of the invention also comprise devices for practising the methods.

During hoisting operations at sea where heavy items having weights in the order of several hundred tonnes are to be disposed on the seabed, for example, the availability of steel ropes having sufficient combined strength and length has become a limiting factor for the size of items that can be handled. The seabed may be located several kilometres below sea level, and the weight of the steel rope therefore becomes significant.

It may therefore be necessary to use fibre ropes to allow the largest items to be submerged into deep waters.

The use of fibre ropes for operations of this type requires consideration of conditions not normally being limiting when using steel ropes. For example, the effective life of a fibre rope comprising a significant proportion of carbon fibre depends directly on the number of load-related flexures that the fibre rope is exposed to.

Oftentimes hoisting operations of this type are heave-compensated, and the lifting rope will therefore be continuously reeled in and out from the winch due to the heave motion of the lifting vessel. Even if the item being lifted is stationary relative to the seabed, the lifting rope will still be reeled in and out, whereby the effective life of a fibre rope is reduced relatively fast.

Moreover, fibre ropes do not possess sufficient shape stability for allowing them to be reeled in several layers onto a drum when full lifting power is applied to the fibre rope.

Similar to a belt, it is known to wind a fibre rope several turns around two parallel drums (traction winch) before pulling the fibre rope onto a storage reel, often in several layers, whilst using a relatively small force.

Such a solution, however, causes the fibre rope to be exposed to flexing every time it enters a drum and every time it leaves the drum. If the fibre rope is wound five parallel turns around the two drums, the rope will be continuously exposed to repeated flexing at ten places, which reduces the effective life to an unacceptable extent.

Fibre ropes designed to transmit the lifting power to a reel are relatively expensive.

It is known to pay out a relatively long rope, which carries a load, by means of a shorter rope. For example, U.S. Patent Application Pub. No. 2005/0191165 describes a method wherein a first length of fibre rope is paid out by means of a lifting wire on a vessel, and wherein the connection of the lifting wire to the fibre rope is moved before a next length of fibre rope, which is connected to the first length of fibre rope, is paid out by means of the lifting wire. The pay-out takes place in a fixed position relative to the vessel.

The object of the invention is to remedy or reduce at least one of the disadvantages of the prior art.

SUMMARY OF THE PREFERRED EMBODIMENTS

A method for hoisting an item at sea is provided, the method comprising:

- by means of a hoisting device on board a vessel, moving the item between different height levels, and alternately carrying the item by at least two hoisting ropes comprising a first hoisting rope and a second hoisting rope. The at least two hoisting ropes are arranged to extend in parallel along at least part of the distance between the item and the hoisting device, wherein the first hoisting rope is releasable connected to the second hoisting rope. A distinctive characteristic of the method is that it comprises the step of suspending the second hoisting rope from a hanger when the second hoisting rope is to carry the load of the item, the hanger being connected to the hoisting device, which is comprised of a crane.

Thereby, the second hoisting rope is exposed to a load from the item only when it is in an extended position, and not when it is paid out via a sheave, for example. By virtue of the hanger being connected to the crane, it is also possible to compensate for movements of the vessel in the horizontal plane.

The method may further comprise one or more of the following features:

- connecting the second hoisting rope directly to the item or via a leading device;
- connecting the first hoisting rope to a first position on the second hoisting rope;
- moving the item between different height levels whilst the first hoisting rope and the portion of the second hoisting rope which is located between the first hoisting rope and the item, are carrying the load of the item;
- upon having suspended the second hoisting rope from the hanger, transferring the load of the item from the first hoisting rope to the second hoisting rope;
- moving the connection between the first hoisting rope and the second hoisting rope to a second position on the second hoisting rope;
- transferring the load of the item to the first hoisting rope and the portion of the second hoisting rope which is located between the first hoisting rope and the item; and
- upon having released the second hoisting rope from the hanger, moving the item between different height levels.

Thus, a second hoisting rope, which for example is several thousand metres long, may be hoisted out by means of a substantially shorter first hoisting rope.

The hanger may be connected to a jib of the crane. Insofar as the first hoisting rope is reeled in and out over the jib, the load is connected to the jib independent of whether it is the first or the second hoisting rope that is carrying the load of the item, the step of which substantially facilitates the positioning of the item relative to the vessel.

The method may be practised by means of a device for hoisting an item at sea, wherein the item, by means of a hoisting device on board a vessel, is movable between different height levels and the item is carried alternately by at least two hoisting ropes comprising a first hoisting rope and a second hoisting rope;

wherein the at least two hoisting ropes are arranged to extend in parallel along at least part of the distance between the item and the hoisting device; and wherein the first hoisting rope is releasably connected to the second hoisting rope. The device is characterized in that the hoisting device, which is comprised of a crane, is provided with a hanger for the second hoisting rope, the hanger being connected to the crane.

The hanger is structured in a manner allowing it to withstand the load of the item on the second hoisting rope.

The hanger is connected to a jib of the crane in order to achieve improved handling of the item, especially when it is suspended from the hanger.

The first hoisting rope may be releasably connected to the second hoisting rope. By so doing, the connection between the first hoisting rope and the second hoisting rope may be moved between different positions on the second hoisting rope.

The first hoisting rope may be releasably connected to the second hoisting rope by means of a connector located on the second hoisting rope. Each connector is structured to fit in a complementary manner with a lock connected to the lifting hook of the first hoisting rope. Alternatively, the first hoisting rope may be connected to the second hoisting rope by means of a clamping fastener or some other suitable device.

For example, the hanger and the lock may be formed with remote-operable latches/dogs which, when in their active positions, are engaged with the corresponding connector.

Usually, the second hoisting rope is formed with several connectors along the longitudinal extent thereof. The connectors may be structured to fit into the hanger. By means of the connectors, several consecutive rope lengths may be joined to form the second hoisting rope. The rope lengths may have different lengths, cross-sectional shapes and cross-sectional dimensions.

Embodiments of the methods and the devices disclosed herein render possible to use relatively inexpensive fibre ropes not capable of being exposed to repeated, load-related flexures.

The fibre rope is exposed to substantial load forces only when it is suspended in the sea with no flexure, and not when lying on a drum or over a sheave. Insofar as all components may be prepared before initiating the hoisting operation, which is carried out without requiring manual coupling work, the method and the device according to the embodiments described herein are suitable for remote-controlled work.

BRIEF DESCRIPTION OF THE DRAWINGS

A non-limiting example of a preferred method and embodiment is described in the following and is depicted in the accompanying drawings, in which.

DETAILED DESCRIPTION OF THE PREFERRED EMBODIMENTS

Figure 1:
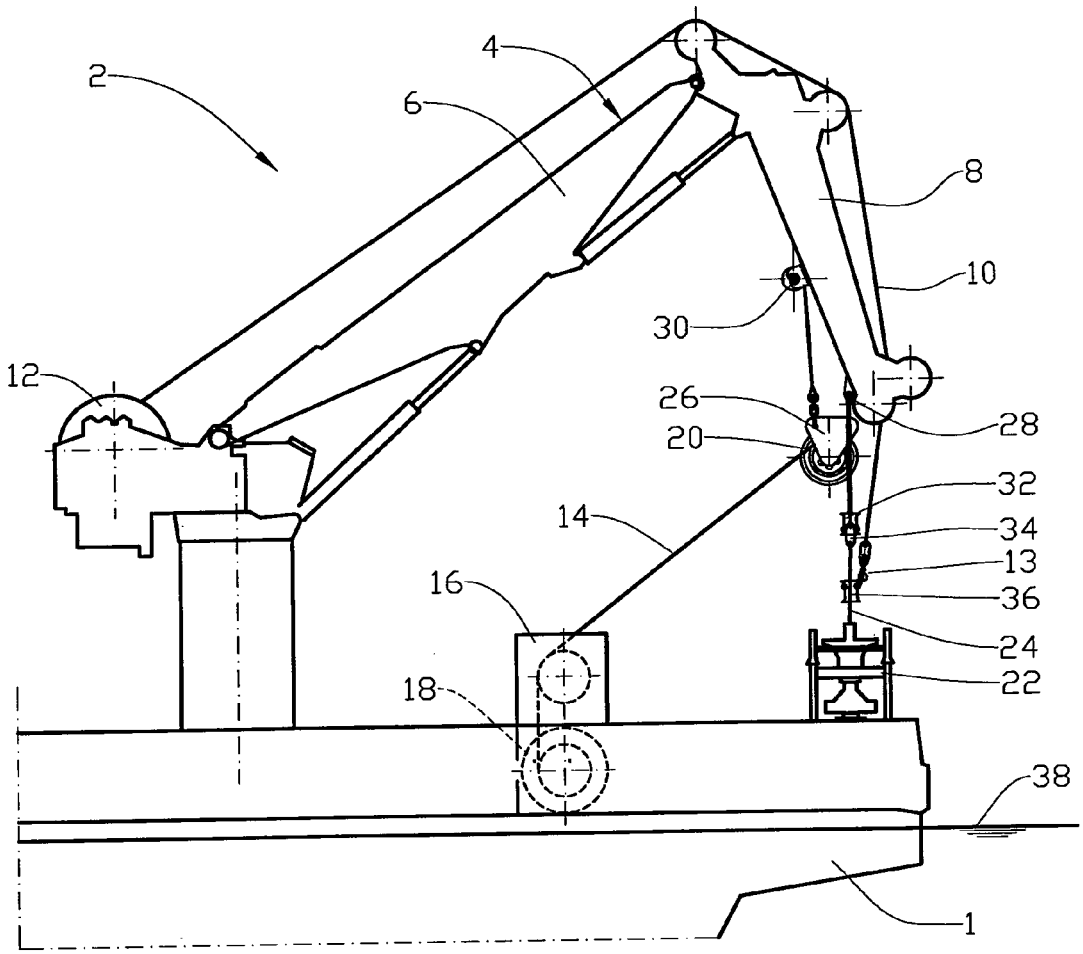
FIG. 1 shows a section of a vessel provided with a hoisting device and a feed mechanism for fibre ropes.

In the drawings, reference numeral 1 indicates a vessel provided with a hoisting device 2 in the form of a crane 4. In this preferred exemplary embodiment, the crane 4 is a pivotal, heave-compensated crane 4 comprising a main boom 6 and a jib 8.

A first hoisting rope 10 extends from a hoisting drum 12 on the crane 4, along the main boom 6, over the jib 8 and onto a lifting hook 13. A second hoisting rope 14 extends from a feed mechanism 16, which comprises a reel 18, over a sheave 20 and onto an item 22 to which it is attached by means of a leading device 24.

The sheave 20 is suspended from the jib 8 by means of a suspension support 26, a pivotal connector 28 and an auxiliary winch 30. The function of the auxiliary winch 30 is to keep the suspension support 26 in a desired position when changing the angle of the jib 8 relative to the horizontal plane.

A hanger 32 for the second hoisting rope 14 is connected to the pivotal connector 28. In order to withstand a tensile force from the second hoisting rope 14, the hanger 32 is structured in a manner allowing it to be releasably connected to the second hoisting rope 14 by means of connectors 34.

Figure 2:
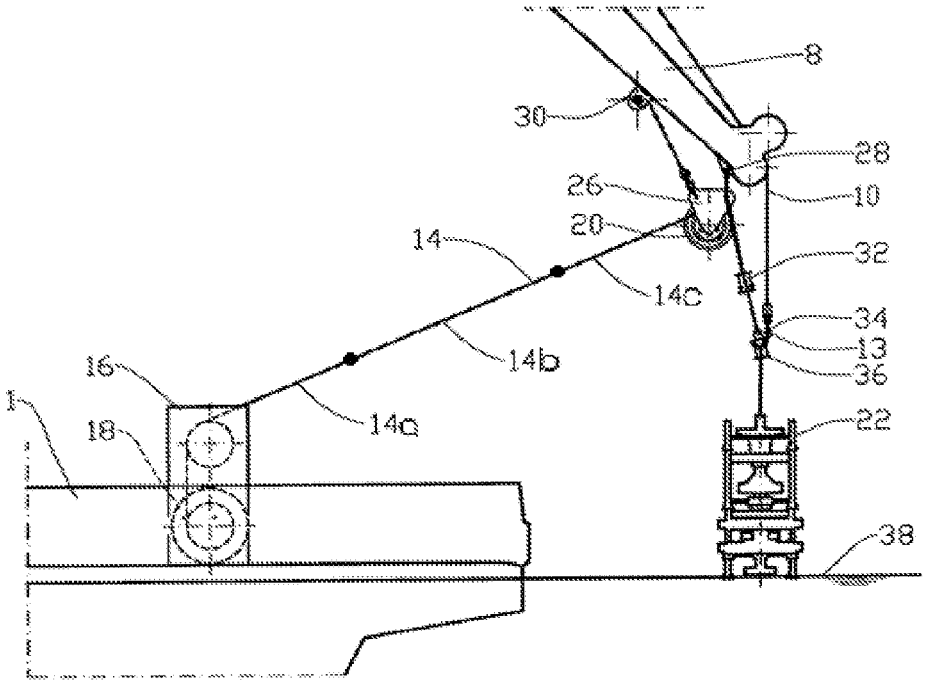
FIG. 2 shows an item after being lifted out from the vessel.
Figure 2:
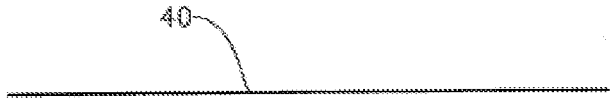

The second hoisting rope 14 is provided with several connectors 34 along the longitudinal extent thereof. For example, a connector 34 may comprise a joint piece (not shown) for the second hoisting rope. The second hoisting rope 14 can be made of multiple ropes 14*a*, 14*b*, 14*c* connected end to end as shown in FIG 2.

The connector 34 is structured to fit in a complementary and releasable manner with a lock 36 connected to the first hoisting rope 10 by means of the lifting hook 13. When released, the lock 36 is movable along the second hoisting rope 14.

The connectors 34 are structured to fit in a lockable manner into the hanger 32, the second hoisting rope extending through the hanger 32.

When an item 22, which is located on the vessel 1 or some other nearby vessel (not shown), is to be submerged into relatively deep waters, the crane 4 is manoeuvred into a position above the item 22, after which the item 22 is connected to the second hoisting rope 14 by means of the leading device 24. The lock 36 on the first hoisting rope 10 is arranged in a movable manner around the second hoisting rope 14, see FIG. 1.

The second hoisting rope 14 may be suspended in the hanger 32 by means of a connector 34. Alternatively, the first hoisting rope 10 may be tightened up so as to allow the lock 36 to engage a connector 34 before lifting the item from the vessel 1 and outwards above the sea 38.

The item 22 is then lowered into the sea 38 whilst the load of the item is taken by the first hoisting rope 10, and whilst the second hoisting rope 14 is being paid out from the feed mechanism 16 and over the sheave 20, see FIG. 2.

Figure 3:
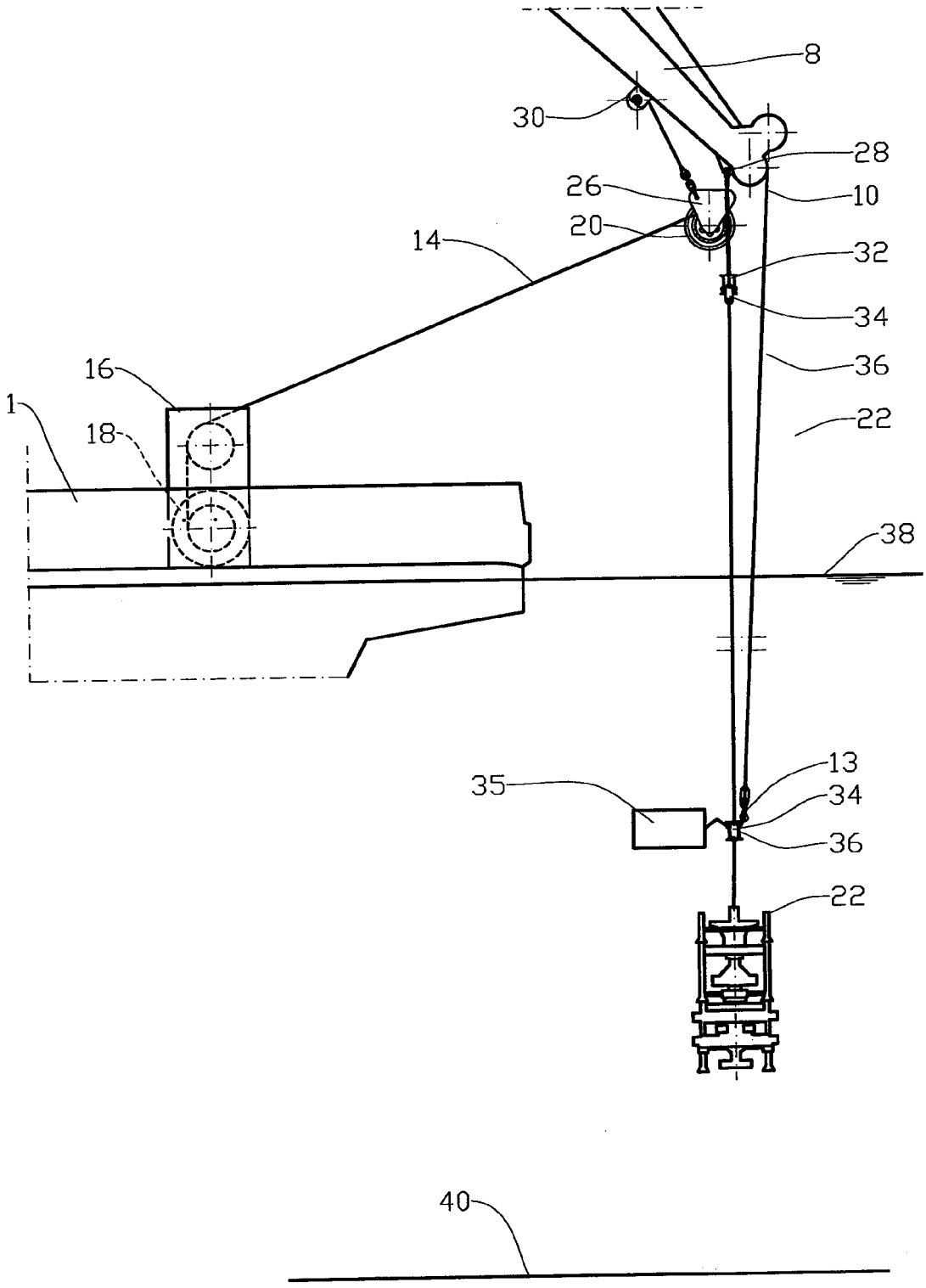
FIG. 3 shows the item early in the lowering phase.
Figure 4:
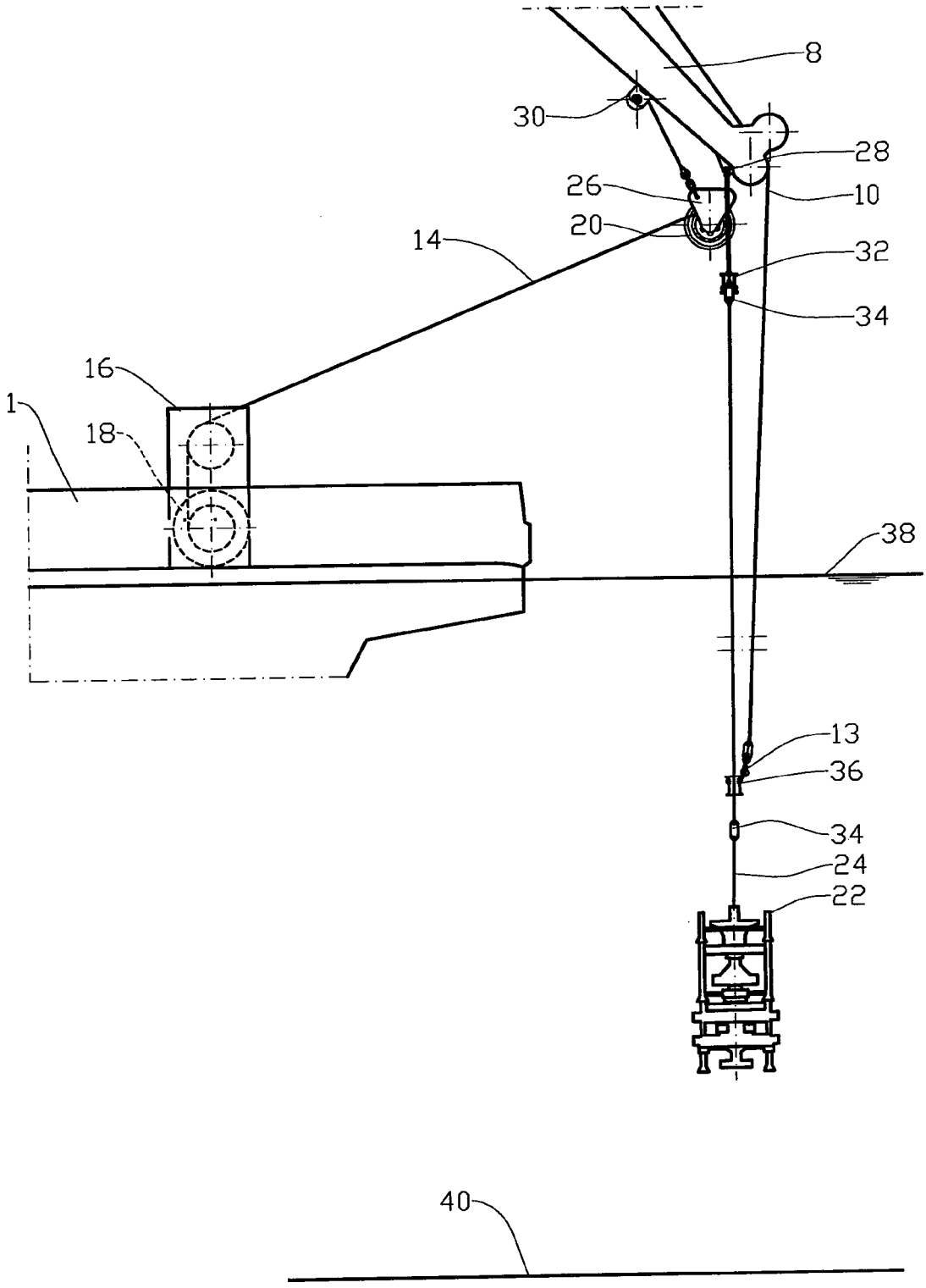
FIG. 4 shows the item later in the lowering phase.

When the first hoisting rope 10 is nearing its full pay-out, the hanger 32 engages a connector 34. By so doing, the load of the item 22 is transferred to the second hoisting rope 14, whereby the first hoisting rope 10 is relieved. The lock 36 is disconnected from the connector 34 to which it was engaged, for example by means of an ROV (Remotely Operated Vehicle) 35, see FIG. 3, or by means of some other actuator (not shown) known to the skilled person, for example by means of a so-called acoustic hook releaser. Then the lock 36 is moved upwards along the second hoisting rope, see FIG. 4.

Thereafter the lock 36 engages a connector 34 located at a level higher up, preferably in the hanger 32, after which the load of the item 22 once again is taken over by the first hoisting rope 10.

The hanger 32 is released from the connector 34 to which it was connected, and the item 22 may then be lowered further into the sea 38 until disposed on the seabed 40. The second hoisting rope 14 is disconnected from the item 22 and both hoisting ropes 10, 14 are reeled in.

Should the sea depth require further lowering beyond the length of the first hoisting rope 10, the operations above may be repeated. Should this not be required, the upper portion of the second hoisting rope 14 may be comprised of a more inexpensive fibre rope which is not designed to withstand the load of the item 22.

If an item is to be hoisted up from the seabed 40, the operations described above are carried out, however in the reverse order.

What is claimed is:

1. A device for hoisting an item at sea, comprising;

a hoisting device including a crane having a crane arm and a hanger pivotally coupled to the crane arm;

a first hoisting rope extending from the crane arm;

a second hoisting rope configured to releasably connect to the hanger;

wherein the first hoisting rope is configured to releasably connect to the second hoisting rope;

wherein the second hoisting rope passes over a sheave suspended from the crane arm, wherein the sheave is coupled to a winch wherein the first hoisting rope has a first position releasably connected to the second hoisting rope and a second position moveably coupled to the second hoisting rope.

2. The device in accordance with claim 1, wherein the first hoisting rope is releasably connected to the second hoisting rope with a connector disposed along the second hoisting rope.

3. The device in accordance with claim 2, wherein the connector is structured to fit into the hanger.

4. The device in accordance with claim 1, wherein a plurality of consecutive rope lengths are joined to form the second hoisting rope.

5. The device in accordance with claim 1, wherein the second hoisting rope has a first position releasably connected to the hanger and a second position moveably coupled to the hanger.

6. The device in accordance with claim 5, wherein the first hoisting rope supports the weight of the item when the first hoisting rope is in the first position and the second hoisting rope is in the second position; and wherein the second hoisting rope supports the weight of the item when the first hoisting rope is in the second position and the second hoisting rope is in the first position.

7. The device in accordance with claim 1, wherein the hanger is pivotally connected to a jib of the crane arm.

8. The device in accordance with claim 1, wherein the sheave is suspended from a pivotal connector coupled to the arm of the hoisting device, and the hanger is coupled to the pivotal connector.

9. A method for lowering an item subsea, comprising:

(a) extending a first hoisting rope from a hoisting device;

(b) pivotally coupling a hanger to the hoisting device;

(c) moveably coupling a second hoisting rope to the hanger, wherein the second hoisting rope passes over a sheave suspended from a winch coupled to the hoisting device;

(d) releasably securing the first hoisting rope to the second hoisting rope and supporting the weight of the item with the first hoisting rope;

(e) lowering the item subsea during (d);

(f) releasably securing the second hoisting rope to the hanger and supporting the weight of the item with the second hoisting rope after (d) and (e); and (g) moving the first hoisting rope along the second hoisting rope during (f).

10. The method in accordance with claim 9, further comprising:

(h) releasably securing the first hoisting rope to the second hoisting rope and supporting the weight of the item with the first hoisting rope after (g); and (i) lowering the item subsea during (h).

11. The method in accordance with claim 10, wherein the first hoisting rope is connected to a lock that releasably engages a connector disposed along the second hoisting rope to secure the first hoisting rope to the second hoisting rope.

12. The method in accordance with claim 11, wherein the connector engages the hanger to releasably secure the second hoisting rope to the hanger.

13. The method in accordance with claim 9, further comprising:

increasing the length of the portion of the first hoisting rope extending from the hoisting device during (e); and increasing the length of the portion of the second hoisting rope extending from the hanger during (e).

14. The method in accordance with claim 10, further comprising repeating (a) thru (i).

15. A method for hoisting an item at sea with a hoisting device, the method comprising:

moving the item between a plurality of different height levels;

alternately supporting the load of the item with a first hoisting rope and a second hoisting rope while moving the item between the plurality of different height levels;

arranging the first hoisting rope and the second hoisting rope to extend in parallel along at least part of the distance between the item and the hoisting device;

releasably connecting the first hoisting rope to the second hoisting rope;

suspending the second hoisting rope from a hanger when the second hoisting rope is supporting the load of the item;

pivotally connecting the hanger to an arm of the hoisting device; and passing the second hoisting rope over a sheave suspended from the arm of the hoisting device, wherein the sheave is coupled to a winch;

wherein the second hoisting rope extends through the hanger.

16. The method in accordance with claim 15, wherein the sheave is suspended from a pivotal connector coupled to the arm of the hoisting device, and the hanger is coupled to the pivotal connector.

17. The method in accordance with claim 15, further comprising:

connecting the second hoisting rope directly to the item or via a leading device;

connecting the first hoisting rope to a first position on the second hoisting rope;

moving the item between a pair of different height levels whilst the first hoisting rope and a portion of the second hoisting rope extending between the first position and the item are supporting the load of the item;

transferring the load of the item from the first hoisting rope to the second hoisting rope after suspending the second hoisting rope from the hanger;

moving the connection between the first hoisting rope and the second hoisting rope to a second position on the second hoisting rope;

transferring the load of the item to the first hoisting rope and the portion of the second hoisting rope extending between the second position and the item; and moving the item between a pair different height levels after releasing the second hoisting rope from the hanger.

18. The method in accordance with claim 15, further comprising connecting the hanger to a jib of the crane.

* * * * *